US006286304B1

(12) United States Patent
Back et al.

(10) Patent No.: US 6,286,304 B1
(45) Date of Patent: Sep. 11, 2001

(54) NOBLE GAS STORAGE AND DELIVERY SYSTEM FOR ION PROPULSION

(75) Inventors: Dwight Douglas Back; Charlie Ramos, both of Melbourne, FL (US)

(73) Assignee: Mainstream Engineering Corporation, Rockledge, FL (US)

( * ) Notice: Subject to any disclaimer, the term of this patent is extended or adjusted under 35 U.S.C. 154(b) by 0 days.

(21) Appl. No.: 09/159,387

(22) Filed: Sep. 23, 1998

(51) Int. Cl.[7] ..... F03H 1/00
(52) U.S. Cl. ..... 60/202; 60/204
(58) Field of Search ..... 60/202, 203, 200.1

(56) References Cited

U.S. PATENT DOCUMENTS 3,159,967 * 12/1964 Webb ..... 60/202
3,258,909 * 7/1966 Davis et al. ..... 60/202
3,807,657 * 4/1974 Brill ..... 60/203.1
4,034,569 * 7/1977 Tchernev ..... 62/2
4,162,901 * 7/1979 Enegess ..... 55/17
5,323,953 * 6/1994 Adderley et al. ..... 228/157
5,912,424 * 6/1999 Judkins et al. ..... 95/143
5,947,421 * 9/1999 Beattie et al. ..... 60/202

FOREIGN PATENT DOCUMENTS 4-8873 * 1/1992 (JP) ..... 60/202
8-4606 * 1/1996 (JP) .
88/01020 * 2/1988 (WO) ..... 60/202

* cited by examiner

*Primary Examiner*—Ted Kim
(74) *Attorney, Agent, or Firm*—Crowell & Moring, L.L.P.

(57) ABSTRACT

A method and system for storing and delivering a noble gas for an ion propulsion system where an adsorbent bearing a noble gas is heated within a storage vessel to desorb the noble gas which is then flowed through a pressure reduction device to a thruster assembly. The pressure and flow is controlled using a flow restrictor and low wattage heater which heats an adsorbent bed containing the noble gas propellant at low pressures. Flow rates of 5–60 sccm can be controlled to within about 0.5% or less and the required input power is generally less than 50 W. This noble gas storage and delivery system and method can be used for earth orbit satellites, and lunar or planetary space missions.

33 Claims, 4 Drawing Sheets

NOBLE GAS STORAGE AND DELIVERY SYSTEM FOR ION PROPULSION

STATEMENT AS TO RIGHTS TO INVENTION MADE UNDER FEDERALLY-SPONSORED RESEARCH AND DEVELOPMENT

The U.S. Government has a paid-up license in this invention and the right in limited circumstances to require the patent owner to license others on reasonable terms as provided for by the terms of contract no. NAS3-97184 awarded by the NASA Lewis Research Center and the Ballistic Missile Defense Organization (BMDO).

BACKGROUND OF THE INVENTION

This invention generally relates to a system and method of storing and delivering noble gas propellants. This invention specifically relates to a system and process for storing and delivering noble gas propellants for an ion propulsion system.

Ion propulsion systems are projected to play an increasingly important role for future planetary exploration, and for commercial and military earth orbit satellites. These systems produce larger specific impulses than their chemical thruster counterparts, yielding more efficient, lighter-weight propulsion systems.

Currently, noble gases (e.g., krypton, xenon) are favored propellants for electric or ion propulsion systems, in part, because they are non-corrosive and generally inert. Xenon is popular for such systems because it features (i) a low ionization potential and (ii) a large molecular weight of 131.3 g/mole.

In present ion propulsion systems, a controlled flow of noble gas (e.g., krypton, xenon) is delivered at low pressure to a thruster from a compressed gas storage vessel. The controlled flow of gas at low pressure (e.g., 20 pounds per square inch gauge ("psig")) from storage at high pressure (e.g., 1200–3000 pounds per square inch absolute ("psia")) is accomplished by a combination of pressure regulators, control valves and flow controllers. The flow rate is generally maintained at between about 5–60 standard cubic centimeters per second ("sccm") for current satellites. The flow rate for xenon would be approximately 0.5–6.0 milligrams per second ("mg/s"). Larger flow rates would be required for larger spacecraft or for planetary exploration.

Delivery systems for ion propulsion thrusters are generally comprised of: (i) a flow control(FC) device and (ii) a compressed gas storage system to store the gas and regulate gas pressure.

The flow control device is connected to the thruster, and the compressed gas storage system (including an upstream pressure management system (PMS)) regulates the pressure to the required flow control feed pressure. A series of pressure regulators, valves (latching, explosive, solenoid), flow restrictors, and heaters are used to deliver the noble gas from the storage system through the flow control device and to the thruster.

The FC device frequently is a thermally operated capillary tube flow restrictor, requiring 100–140 Watts. By adjusting the temperature of the gas, and hence its temperature-dependent viscosity, the flow rate of the gas flowing through the device is controlled. Other FC devices employ a dual solenoid valve assembly separated by a small ullage volume. As the solenoid valves are alternately opened and closed, the noble gas in the ullage fills and empties much like a peristaltic pump.

Compressed gas storage systems face inherent engineering challenges. First, they simultaneously must maintain high storage pressures while providing a regulated release of gas at lower pressures (e.g., 20 psig). Second, as the gas is used and the pressure of the vessel decreases, additional hardware and/or controls must be used to maintain a consistent flow rate. Third, these storage systems can be dangerous because the stored energy of the compressed gases may be equivalent to several pounds of TNT.

Another difficulty with compressed gas storage systems arises in space-based applications where the noble gas exists in multiple phases. This is problematic because gas-liquid two-phase systems are difficult to separate in zero-gravity, necessitating separation of the phases and/or a pre-expansion of the two-phase mixture in order to ensure gaseous delivery to the FC device.

For example, when exposed to the cold temperatures of outer space, xenon condenses to a liquid phase resulting in a two-phase system. Xenon has a critical temperature of 290 K which falls in the temperature range experienced by gas storage systems on orbiting satellites, e.g., 90 K to 450 K. The exact range depends, in part, on the insulation and temperature controls employed. The volume of compressed xenon, loaded on earth at a nominal 25° C. to pressures of about 1000 psia or greater, is about 0.9 $cm^3/g$ or less, and the critical volume of Xe is 0.9 $cm^3/g$.

A further difficulty is that gas-liquid two-phase systems are unreliable in providing a noble gas to an ion propulsion thruster, which is exacerbated by the sensitivity of ion propulsion systems to propellant flow variations. Another disadvantage is that two-phase storage systems may require venting of the noble gas, both prior to launch and in space. Venting is an expensive practice because satellite systems may use several thousand pounds of noble gas (e.g., xenon, is currently at $1,000 per kilogram or more). Moreover, venting adds complexity to the vessel and system design, further increasing costs. In space, venting may be necessary to control the temperature and pressure of the two-phase fluid. This results in extra payload, launch costs and wasted propellant.

Additionally, the engineering design of gas-liquid two-phase systems requires that the thermal control elements (i.e., heaters and coolers) contact the fluid regardless of the fluid level in the storage vessel, which increases engineering design costs. Because even partial vaporization of the liquid in the storage vessel at pre-launch would create a high pressure "bomb" of several thousands pounds of pressure, protective thicker-walled tanks are required, which increases the weight penalty over other gas storage systems.

Nonetheless, two-phase storage systems have continued to be used because of the spatial advantage of storing noble gas in liquid form.

In short, two-phase storage systems have many disadvantages for space-based ion propulsion system applications. They are complicated and expensive, demand special temperature controls, have large power requirements (e.g., 100+ W), require special safety features, and must be designed and built specially for operation in an outer space environment (e.g., factoring in orbit parameters, system geometry, etc.). These systems are more difficult to design because of the two-phase separation and the necessity of pre-expansion of the two-phase mixture to assure proper vapor delivery to the FC device. And, for pre-launch logistical reasons, these systems require venting, this further increasing design complexity and expense.

SUMMARY OF THE INVENTION

It is, therefore, the purpose of the invention to provide an alternate system and method of storing and delivering noble gases, particularly xenon, for ion propulsion systems that is safer, simpler, lighter, less expensive to build and operate, and more efficient than currently available methods employing compressed gas and two-phase storage systems. The invention achieves this purpose, as described below.

In the invented system, a noble gas propellant is stored on an adsorbent within a storage vessel. A fluid passageway is provided, preferably by tubing, between the storage vessel and a thruster assembly. A thruster assembly generally comprises a thruster and a neutralizing cathode. Desorbed propellant flowing in the passageway from the storage vessel must pass through an isolation valve and then a pressure reduction device before reaching the thruster assembly. This ensures that a controllable, even flow of low pressure propellant is delivered to the thruster assembly. Preferably, at least one filter is arranged upstream of the isolation valve to prevent adsorbent particles and the like from being introduced in the propellant stream delivered to the thruster assembly.

Preferably, the adsorbent is an activated carbon. Also, the noble gas propellant is comprised of one or more noble gases, and xenon is preferred as one of or the sole noble gas included.

A heating device is provided to desorb the adsorbed noble gas propellant from the adsorbent. The heating device may take a number of forms and may be wholly or partially internal or external to the storage vessel. The heating device may rely on heat conduction, radiation, solar radiation, radioisotope, fluid heat exchange or any other heat source or heating method which can effectively desorb the propellant from the adsorbent.

The pressure within the storage vessel is controlled, in part, by the heating device which is operated and controlled in conjunction with a pressure or flow sensor and a controller. The pressure sensor is operatively associated with the storage vessel and may also be internal or external to the storage vessel. The flow sensor may be operatively associated with the storage vessel, the tubing, the thruster or the thruster assembly.

The pressure reduction device employed is preferably a porous metal flow restrictor, but may operate by way of porous metal, porous ceramic, orifices, capillary tubes and/or valves. Depending on the type, a restrictor heater connected to the flow restrictor may provide for more accurate control of the propellant flow.

Also, better control of the temperature and, hence, the flow of desorbed propellant may be achieved by insulating the storage vessel. While any insulation suitable for the operating environment may be employed, those insulations preferred include multilayer insulation, foam insulation, paint and/or radiation shielding material.

In the invented method of storing and delivering a noble gas propellant in an ion propulsion system, a noble gas propellant is first stored on an adsorbent within a storage vessel of the system. Second, a heating device is employed to heat and desorb the propellant from adsorbent. The desorption is controlled, in part, by the level of heating supplied by the heating device. In turn, this heating is controlled by a controller in communication with both the heating device and a pressure or flow sensor. The desorbed propellant increases the pressure within the storage vessel. In the third step, the propellant is flowed through tubing toward a thruster assembly. As the propellant flows through the system, it is filtered to remove particles. An isolation valve is used to control the flow rate of the propellant to the thruster assembly. Fourth, a pressure reduction device and optional restrictor heater further control the flow rate and reduce the pressure of the propellant delivered to the thruster assembly. Fifth, once the propellant pressure has been reduced, it is then flowed to the thruster assembly, where it may be divided between the thruster and the neutralizing cathode.

Activated carbons are adsorbents with large gravimetric storage capacities for noble gases. Other suitable adsorbents include molecular sieves. Typical storage capacities for activated carbons are 0.5–2.0 kilograms Xe per kilogram of activated carbon over the pressure range of about 100–1000 psia. Granular or powdered carbons having mesh sizes ranging from 4 to 400 (Tyler Equivalent Designation) are preferred. Also preferred are pelletized and monolithic carbon. These latter two forms of adsorbent are advantageous because they are compact and reduce the required volume of storage vessel 4. In addition, silver impregnated activated carbon is preferred because it offers improved storage capacity for noble gases.

The invention, employing an adsorbent storage system, offers a number of advantages over compressed gas storage systems. For comparison purposes, a preferred xenon ion propulsion system is discussed. First, in terms of weight, the solid storage system of the invention is competitive with compressed gas storage at a total propulsion system weight of approximately 1.1–1.3 kilograms (including xenon and all flow control and storage hardware) per kilogram xenon. Second, the associated velocity increment is also competitive. Assuming a 340 kg spacecraft with 40 kg Xe propellant, the velocity increment is at a maximum approximately 3% lower than compressed gas storage. Third, the storage volume of Xe can be reduced below that of compressed gas storage, with values typically between approximately 0.4 and 1.5 $cm^3/g$ Xe. Fourth, compared to compressed gas systems having storage pressures of 1200–3000 psia, the stored energy of this invention typically will be lower by a factor of 5 or more.

While storage pressures of Xe on an adsorbent bed can reach 1000 psia, a pressure of 300 psia or less in space at sub-ambient temperatures is preferred. This is because storage of the propellant (e.g., xenon) at a lower pressure means less and simpler control hardware is required. Compared to compressed gas systems, the pressure at which noble gas is stored while on earth can be much greater than the eventual space-use pressure because the adsorbent, through equilibrium, decreases the pressure of the noble gas propellant. A noble gas stored in the system at approximately 25° C. on earth shows a marked decrease in pressure once the system becomes space-borne.

As an illustration, an activated carbon loaded with Xe at 25° C. (298 K) to pressures of 222 and 700 psia had final pressures of 60 and 152 psia, respectively, at a temperature of −50 C (223 K). A compressed gas decreases in pressure by approximately the absolute temperature ratio, e.g, 223 K/298 K=0.75. In contrast, the pressure reduction ratio achieved by an adsorbent-gas system, e.g., 152 psia/700 psia=0.22, is much greater. Thus, compared to compressed gas systems, the invention can provide significantly lower propellant pressures for ion propulsion systems during space-borne operation.

In determining the actual pressure reduction achieved, the space or orbit temperature must be determined. This temperature will vary depending on the location of the storage vessel and degree of insulation, but in general the temperature of the adsorbent should be within a range of 90–230 K. This temperature range was determined by considering various space/orbit temperatures: the average LEO/GEO temperature is about 230 K, the average shaded moon surface temperature is about 153 K, the average Mars orbit and surface temperature is about 225 K, the average asteroid belt temperature is about 161 K, the average Jupiter orbit temperature is about 122 K, and the average Saturn orbit temperature is about 90 K.

BRIEF DESCRIPTION OF THE DRAWINGS

Other objects, advantages and novel features of the present invention will become apparent from the following detailed description when considered in conjunction with the accompanying drawings wherein.

DETAILED DESCRIPTION OF THE INVENTION

Figure 1:
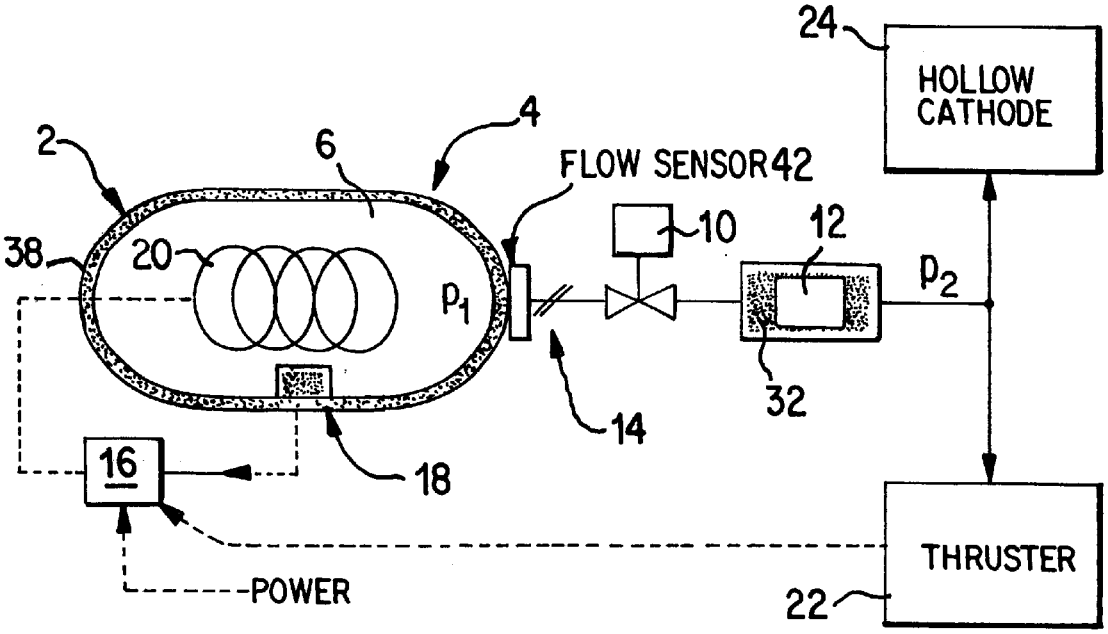
FIG. 1 is a schematic representation of a first currently preferred embodiment of the present invention comprising a noble gas storage and delivery system.
Figure 2:
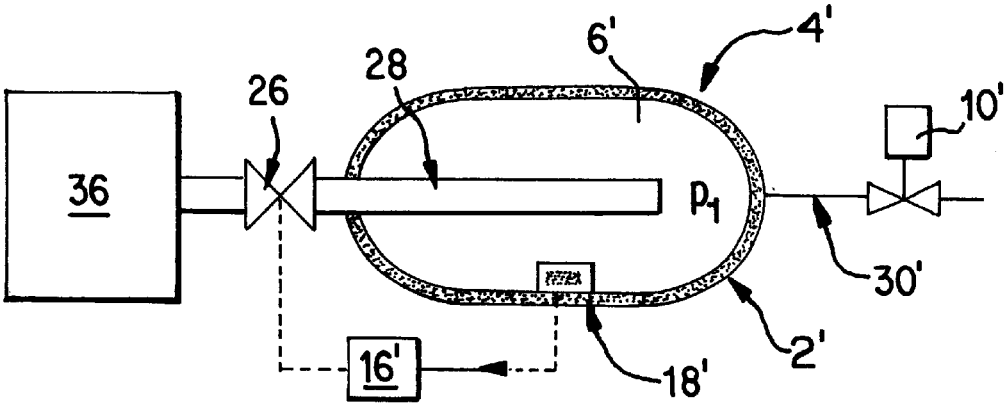
FIG. 2 is a schematic representation of a second currently preferred embodiment of the present invention where the storage vessel uses waste heat to desorb the noble gas from the adsorbent.

FIGS. 1–2 depict alternative embodiments of a device for storing and delivering a noble gas propellant in an ion propulsion system in accordance with the present invention. Like reference numbers in both figures refer to like parts.

In FIG. 1, the device 2 generally may be described as being comprised of a storage vessel 4 containing an adsorbent bed 6 on which a noble gas is absorbed; an isolation valve 10; a porous metal flow restrictor 12; one or more filters 14; tubing 30; a controller 16; a pressure sensor 18; and a heater 20.

Noble gas is adhered to or absorbed on the adsorbent bed 6 enclosed in the storage vessel 4 connected to the isolation valve 10 and the porous metal flow restrictor 12 by the tubing 30. Between the storage vessel 4 and the isolation valve 10 are filter(s) 14 sufficient to prevent the flow of adsorbent particulates or powder into isolation valve 10 and/or the thruster assembly 40. One or more filters 14 having a pore size of approximately 0.5–10 micrometers is adequate for this purpose.

In operation, the heater 20 causes the noble gas to desorb from adsorbent bed 6 and generate a gas pressure $p_1$. The heater 20 may be of an internal or an external design. By heating the adsorbent bed, the thermodynamic equilibrium inside the storage vessel is shifted so as to generate gas pressure $p_1$. At a pre-determined threshold level for $p_1$, the isolation valve 10 opens, allowing the desorbed noble gas to flow from the higher pressure of the storage vessel 4 through the tubing 30 to the porous metal flow restrictor 12 and then to the thruster assembly 40, comprising thruster 22 and hollow neutralizing cathode 24.

The flowing noble gas 8 can be split between thruster 22 and neutralizing cathode 24 in order to mitigate charge build-up in the system. A charge build-up would ultimately turn the exhaust back into the thruster assembly 40. The pressure $p_2$ downstream of porous metal flow restrictor 12 generally will be a vacuum, resulting in a pressure drop with storage vessel 4. As a result, noble gas 8 flows through tubing 30 from storage vessel 4 to thruster assembly 40, comprised of thruster 22 (shown schematically) and neutralizing cathode 24.

The temperature and, consequently, the pressure $p_1$ in storage vessel 4 is adjusted via heater 20 by controller 16 which receives feedback from pressure sensor 18. Controller 16 may be a proportional, proportional-integral or proportional-integral-derivative (PID) controllers. The controller 16 may alternatively receive feedback from a flow sensor 42, depicted schematically in FIG. 1.

Figure 5A:
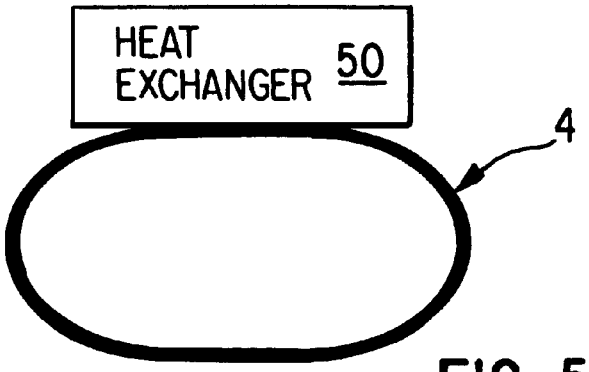
FIGS. 5*a*–5*c* are schematic representations of alternative heat sources for use in the present intention shown in FIGS. 1–2.
Figure 5B:
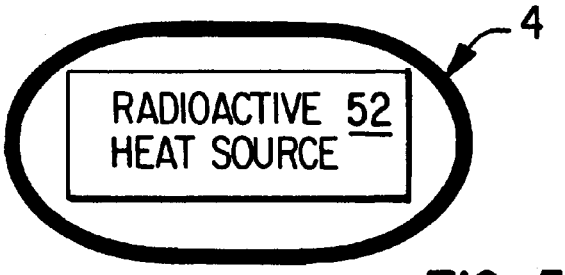
Figure 5C:
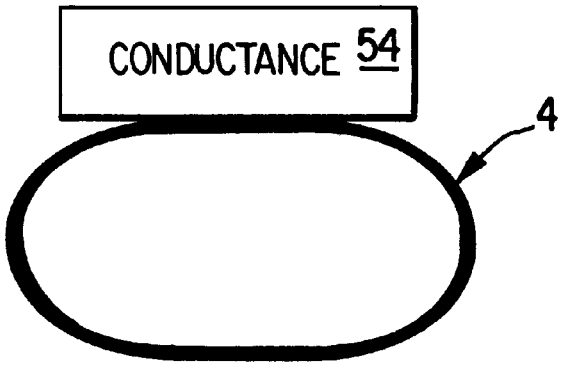

Heat input to storage vessel 4 may be generated from electrical resistance elements in internal heater 6 or by heat pipes, heat conduction through metal 54, solar radiation, radioisotope sources 52, or fluid heat exchangers 50. For heat pipes, fluid heat exchangers, or heat conduction through solid materials, the ultimate heat source could be a power processing unit 36 or other heat generating equipment. Alternative heat sources for use in the present invention of FIGS. 1–2 are depicted schematically in FIGS. 5*a*–5*c*.

Storage vessel 4 may be insulated with insulation 38 to reduce radiative heating of the vessel and contents. Insulation 38 can be multi-layer-insulation (MLI) type, foam insulation, paint, and/or other radiation shielding materials. Insulation 38 also reduces heat losses from adsorbent bed 6 to surroundings when adsorbent bed 6 is heated to generate the appropriate pressure $p_1$. Since the heater 20, thruster 22, and neutralizing cathode 24 will generally operate intermittently, the salvage or storage of heat within the adsorbent bed 6 reduces the heat up time when the thruster 22 is activated after a period of inactivity.

Flow restrictor 12 reduces the pressure and controls the flow from adsorbent bed 6. Flow restrictor 12 is preferably comprised of a porous metal, but may use porous ceramics, orifices, capillary tubes, and valves. Employing restrictor heater 32 is preferred because it can provide increased control of the noble gas 8 flow rate than by simply modulating pressure $P_1$. Restrictor heater 32 provides increased control of the noble gas 8 flow rate by thermally expanding and contracting the porous metal of the porous metal flow restrictor 12. Since thermal expansion characteristics vary for different materials, the benefits of employing restrictor heater 32 vary. As an example, a 30% reduction in flow rate is achievable using a stainless steel restrictor heated to 100° C. from 25° C.

Heating restrictor 12 can change the local viscosity of the flowing gas with sufficient time for heat transfer to noble gas 8 from restrictor 12 and connecting parts. As noble gas 8 viscosity increases with temperature, the flow rate decreases accordingly.

The flow rate through porous metal flow restrictor 12 can be represented mathematically by the equation:

$$V_s(sccm) = a\left(\sqrt{1 + b(p_1^2 - p_2^2)} - 1\right) \quad [1]$$

where $V_s$ is the flow rate in sccm, $p_1$ is pressure in storage vessel 4, $p_2$ is pressure downstream of flow restrictor 12, and a and b are constants.

As understood by those skilled in the art, and according to Equation 1, a change in pressure $p_1$ yields a change in flow rate $V_s$. The flow rate to thruster assembly 40 can be controlled by heating storage vessel 4 and adsorbent bed 6 because pressure $p_1$ in the storage vessel 4 varies with temperature.

The temperature-pressure relationship can be described by differential equation:

$$\partial \ln(p_1) = -\frac{\Delta H(T_1, x)}{R} \partial \left(\frac{1}{T_1}\right) \quad [2]$$

where ΔH is the enthalpy of desorption (greater than zero) and a function of $T_1$ and x; R is the ideal gas law constant; x is the concentration or loading of the adsorbent (e.g., grams of Xe per gram of adsorbent); and $T_1$ is absolute temperature. Equation 2 shows that as the temperature increases, pressure increases non-linearly.

In a second preferred embodiment, depicted in FIG. 2, device 2' generally comprises storage vessel 4' containing adsorbent bed 6' to which noble gas 8' can adhere; isolation valve 10'; controller 16'; pressure sensor 18'; tubing 30'; heat pipe 28; control valve 26; and power processing unit 36. Heat pipe 28 is connected to power processing unit 36 of the ion propulsion system. The flow of heat within heat pipe 28, and thus the heat delivered to adsorbent bed 61 in storage vessel 4', is regulated by control valve 26 which communicates with the controller 16' and pressure sensor 18'. Power processing units for ion propulsion systems produce up to about 150 W of waste heat, providing the requisite power for the storage and delivery system of the present invention.

Heat is delivered to adsorbent bed 6' in storage vessel 4' from heat pipe 28 or other fluid-based heat transfer device and could be controlled by control valve 26. Although pressure sensor 18' feedback control is the preferred method for controlling the noble gas 8' flow rate via heating, the flow rate may be controlled by adsorption bed 6' heating using feedback from the thruster 22' or other device which generates an electrical signal that is proportional to the flow rate of noble gas 8'. Isolation valve 10' is controlled by the controller 16' which dictates when the thruster is to be activated for propulsion.

The heat requirement of adsorbent bed 6 is theoretically, (i.e., with no heat losses) in the range of 0.5–2.0 watts based on the heat of desorption AH determined through isotherm measurements at various temperatures for several adsorbents and combined with typical flow rates of approximately 0.5–6.0 mg/s used in current ion propulsion systems. Because of heat losses due to convention, conduction, and radiation, these power requirements are in practice larger. These power requirements climb to approximately 50 Watts for a flow rate of 60 sccm; in most circumstances the power requirement is less than 20 Watts.

Using the embodiment of FIG. 1, stable Xe flow rates were measured for various porous metal flow restrictors having flow rates ranging from about 5–60 sccm (0.5–6.0 mg/s) with a variation within the stability and linearity of the flow rate measuring device.

Figure 3:
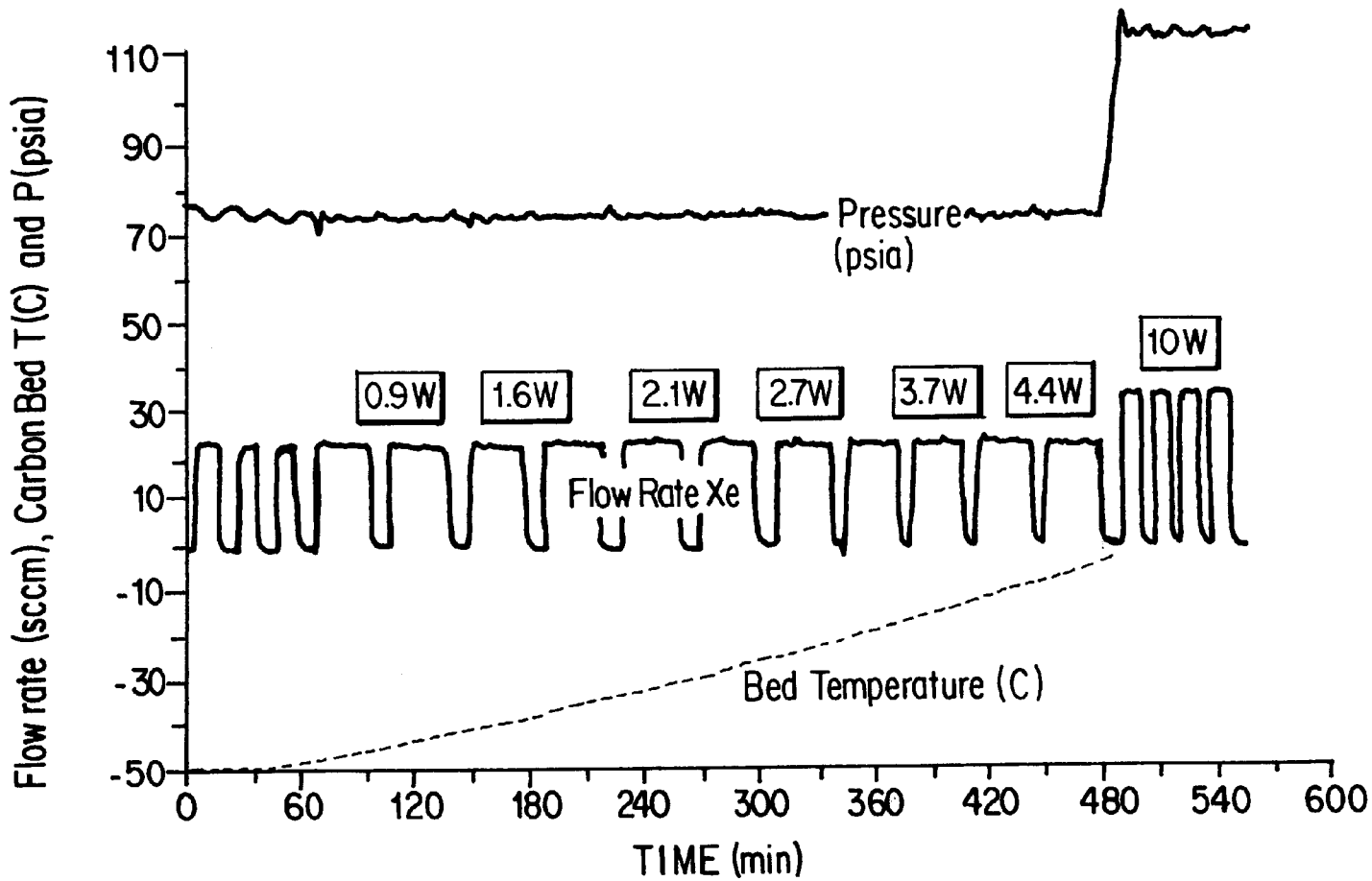
FIG. 3 is a chart depicting the flow rate of Xe through a porous metal flow restrictor undergoing various cycling tests.
Figure 4:
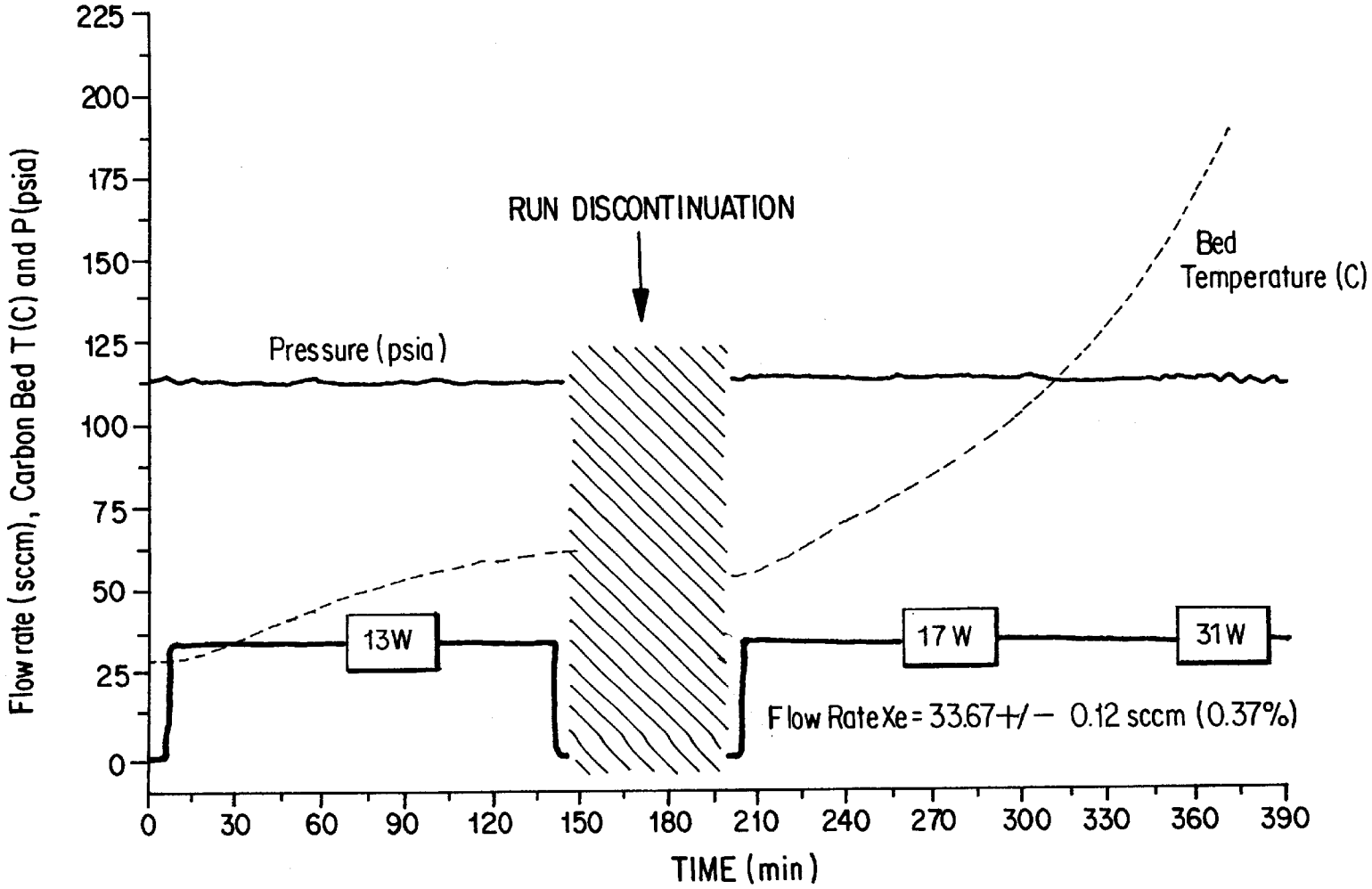
FIG. 4 is a chart depicting the stability of the flow rate produced by a solid storage Xe flow control system.

FIGS. 3 and 4 show the results from flow tests with a system configured as in FIG. 1 using activated carbon as the adsorbent.

FIG. 3 illustrates the response of the xenon flow rate as the isolation valve 10' is repeatedly opened and closed for varying durations. It shows the flow control of xenon supplied by an activated carbon bed flowing through a porous metal flow restrictor at −50° C. Various cycles are shown with the bed at 75 psia nominal, then switched to 115 psia nominal toward the end of the test. The pressure and temperature of the storage vessel and the power requirements for each stage in the test are shown. Power requirements at various stages of the test are shown in boxed-in numbers.

FIG. 4 shows an extended time test of Xe flow from a heated activated carbon bed illustrating the stability of the flow. Shown is the flow control of Xe supplied by an activated carbon bed at −50° C. and flowing through a porous metal flow restrictor. Power requirements are shown in boxes and the bed is taken to near-depletion at end of test. As shown, the flow rate was stable at 33.67 sccm +/−0.37% for a flow time of 5 hours, which is representative of results found in other tests. The actual fluctuation in flow rate is likely lower because the accuracy and linearity of the flow rate measuring device are generally larger than the observed fluctuations in this case. Thus, the observed fluctuations may be due to the measuring instrument itself.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof. Also, the phraseology and terminology employed herein are for description and not limitation.

What is claimed is:

1. A method for storing and delivering a noble gas propellant in an ion propulsion system, comprising the steps of:

(a) storing on an adsorbent in a storage vessel a noble gas propellant comprising at least one noble gas;

(b) desorbing the noble gas propellant from the adsorbent by heating, thereby increasing a pressure within the storage vessel;

(c) flowing the noble gas propellant from the storage vessel;

(d) reducing the pressure of the noble gas propellant by a porous metal flow restrictor, and heating the porous metal flow restrictor to increase a control of a flow rate of the noble gas propellant; and (e) flowing the noble gas propellent to at least one of (i) a thruster assembly and (ii) a thruster and a neutralizing cathode.

2. The method of claim 1, in step (e), wherein the thruster assembly is comprised of a thruster and a neutralizing cathode.

3. The method of claim 1, wherein at least one noble gas is xenon.

4. The method of claim 1, step (b) further comprising the heating effected by a controller in communication with (i) a heating device and (ii) a pressure sensor for the storage vessel.

5. The method of claim 4, in step (b) a power requirement of the heating device is less than about 51 Watts.

6. The method of claim 1, step (b) further comprising the heating effected by a controller in communication with (i) a heating device and (ii) a flow sensor.

7. The method of claim 1, in step (a) the adsorbent comprises activated carbon selected from the group consisting of powder, granules, pellets or monolith.

8. The method of claim 7, in step (a) the adsorbent is silver impregnated.

9. The method of claim 1, in step (a) the adsorbent comprises molecular sieve selected from the group consisting of powder, granules, pellets or monolith.

10. The method of claim 1, wherein a noble gas propellant flow rate is between about 0.5 and 6.0 mg/s.

11. The method of claim 1, step (b) further comprising heating the adsorbent with a heating device located within the storage vessel.

12. The method of claim 1, step (b) further comprising heating the adsorbent with a heating device located at least partially outside the storage vessel.

13. The method of claim 1, step (b) further comprising heating the adsorbent within the storage vessel using a heat source selected from the group consisting of a heat pipe, heat exchanger, a radioactive heat source, an electrical resistance element, and waste heat.

14. A method for storing and delivering a noble gas propellant in an ion propulsion system, comprising the steps of:

(a) storing on a an activated carbon adsorbent in a storage vessel a noble gas propellant comprising at least one noble gas, the at least one noble gas including xenon;

(b) desorbing the noble gas propellant from the adsorbent by heating, increasing a pressure within the storage vessel;

(c) flowing the noble gas propellant from the storage vessel;

(d) reducing the pressure of the noble gas propellant via a porous metal flow restrictor, and heating the porous metal flow restrictor to increase a flow rate of the noble gas propellant; and (e) flowing the noble gas propellent to at least one of a (i) thruster assembly and (ii) a thruster and a neutralizing cathode.

15. The method of claim 14, in step (e), wherein the thruster assembly is comprised of a thruster and a neutralizing cathode.

16. The method of claim 14, step (b) further comprising the heating effected by a controller in communication with (i) a heating device and (ii) a pressure sensor for the storage vessel.

17. The method of claim 14, step (b) further comprising the heating effected by a controller in communication with (i) a heating device and (ii) a flow sensor.

18. The method of claim 14, wherein the noble gas propellant flow rate is between about 0.5 and 6.0 mg/s.

19. The method of claim 14, step (b) further comprising heating the absorbent with a heating device located within a storage vessel.

20. The method of claim 14, step (b) further comprising heating the absorbent with a heating device located at least partially outside the storage vessel.

21. The method of claim 14, step (b) further comprising heating the absorbent within the storage vessel using a heat source selected from the group consisting of a heat pipe, heat exchanger, a radioactive heat source, an electrical resistance element, and waste heat.

22. The method of claim 14, step (a) further comprising the activated carbon in a form selected from the group consisting of powder, granules, pellets, and monolith.

23. The method of claim 14, step (a) further comprising the activated carbon is silver impregnated.

24. A noble gas storage and delivery system for ion propulsion, comprising:

a storage vessel containing an adsorbent for adsorbing a noble gas propellant, wherein the noble gas propellant comprises at least one noble gas;

an isolation valve and a pressure reduction device operatively associated with the storage vessel, wherein the pressure reduction device is a porous metal flow restrictor;

at least one filter operatively connected between the storage vessel and the isolation valve;

a heating device for heating the absorbent;

a pressure sensor operatively associated with the storage vessel, for determining the pressure inside the storage vessel;

a controller operatively associated with the heating device for adjusting a pressure in the storage vessel by controlling temperature within the storage vessel;

a thruster assembly comprising a neutralizing cathode and a thruster;

further comprising a restrictor heater connected to and for heating the pressure reduction device, wherein a noble gas propellant flow rate is increased; and wherein a fluid passageway is provided from the storage vessel to the thruster assembly.

25. The system of claim 24, wherein the thruster assembly is comprised of a thruster and a neutralizing cathode.

26. The system of claim 25, wherein in operation, the flowing noble gas is flowed to at least one of the thruster and the neutralizing cathode.

27. The system of claim 24, wherein the heating device is internal to the storage vessel.

28. The system of claim 24, wherein the heating device is external to the storage vessel.

29. The system of claim 24, wherein the heating device is selected from the group consisting of: a conductive heating device, a radiant heating device, a solar heating device, a radioisotope heating device, and a fluid heat exchange heating device.

30. The system of claim 24, wherein the heating device is a heat pipe.

31. The system of claim 24, wherein the heating device is connected to a power processing unit.

32. The system of claim 24, wherein the storage vessel is insulated.

33. The system of claim 32, wherein the storage vessel is insulated by one selected from the group consisting of: multilayer insulation, foam insulation, paint and radiation shielding material.

* * * * *